US008158571B2

(12) United States Patent
Alonso et al.

(10) Patent No.: US 8,158,571 B2
(45) Date of Patent: Apr. 17, 2012

(54) FABRIC TREATMENT COMPOSITION COMPRISING A CORE-SHELL PARTICLE BOUND TO A PHTHALATE-CONTAINING POLYMER

(75) Inventors: Coralie Claudine Alonso, Wirral (GB); Paul Ferguson, Wirral (GB); Christopher Clarkson Jones, Wirral (GB); David Richard Arthur Mealing, Wirral (GB); Jinfang Wang, Shanghai (CN)

(73) Assignee: Conopco Inc., Englewood Cliffs, NJ (US)

( * ) Notice: Subject to any disclaimer, the term of this patent is extended or adjusted under 35 U.S.C. 154(b) by 64 days.

(21) Appl. No.: 12/678,627

(22) PCT Filed: Aug. 19, 2008

(86) PCT No.: PCT/EP2008/060841

§ 371 (c)(1),
(2), (4) Date: Aug. 24, 2010

(87) PCT Pub. No.: WO2009/037060

PCT Pub. Date: Mar. 26, 2009

(65) Prior Publication Data

US 2010/0311637 A1 Dec. 9, 2010

(30) Foreign Application Priority Data

Sep. 22, 2007 (GB) ..... 0718532.5

(51) Int. Cl.
*C11D 3/50* (2006.01)
*C11D 3/37* (2006.01)

(52) U.S. Cl. ..... 510/441; 510/101; 510/276; 510/327; 510/329; 510/349; 510/400; 510/504; 510/515; 510/517

(58) Field of Classification Search ..... 510/101, 510/276, 327, 329, 349, 400, 441, 504, 515, 510/517

See application file for complete search history.

(56) References Cited

U.S. PATENT DOCUMENTS

| | | | | |
|---|---|---|---|---|
| 4,081,384 | A * | 3/1978 | Pracht | 510/523 |
| 5,935,826 | A * | 8/1999 | Blue et al. | 435/96 |
| 7,285,523 | B1 | 10/2007 | Seydel et al. | |
| 8,058,224 | B2 * | 11/2011 | Morgan et al. | 510/519 |
| 2003/0091529 | A1 * | 5/2003 | Shah | 424/76.3 |
| 2005/0273942 | A1 | 12/2005 | Ferguson et al. | |
| 2011/0086788 | A1 * | 4/2011 | Smets et al. | 510/105 |

FOREIGN PATENT DOCUMENTS

| | | | |
|---|---|---|---|
| EP | 1 741 775 | | 1/2007 |
| GB | 2 432 851 | | 6/2007 |
| GB | 2432851 | * | 6/2007 |
| WO | 94/19448 | | 1/1994 |
| WO | 98/00500 | * | 1/1998 |
| WO | 99/36469 | | 7/1999 |
| WO | 00/08861 | | 2/2000 |
| WO | 01/46357 | | 6/2001 |
| WO | 03/014278 | | 2/2003 |
| WO | 2007/062733 A1 | | 6/2007 |

OTHER PUBLICATIONS

International Search Report, PCT/EP2006/060841, mailed Dec. 5, 2008, 3 pp.
GB Search Report, GB0718532.5. dated Apr. 22, 2008, 1 p.

* cited by examiner

*Primary Examiner* — Charles Boyer
(74) *Attorney, Agent, or Firm* — Rimma Mitelman

(57) ABSTRACT

A particle (preferably a core-shell encapsulate) comprising a benefit agent (preferably a perfume), said particle being bound to a non-cationic deposition aid which is substantive to polyester, wherein the non-cationic deposition aid is a polymer derivable from dicarboxylic acids and polyols. Preferably the polymer comprises units derived from (poly)ethylene glycol and terephthalate, most preferably selected from the group comprising PET/POET, PEG/POET, PET/PEG and phthalate/glycerol/ethylene glycol polymers. The invention also provides a method for producing improved benefit agent particles which comprises the step of covalently linking or co-polymerising a deposition aid which is substantive to polyester to a particle comprises the benefit agent. The particles find particular utility in laundry treatment compositions comprising (a) anionic and/or nonionic surfactant, or (b) cationic fabric conditioner and further comprising core-shell particles, wherein said particles have, incorporated in the shell a polyester-substantive deposition aid which is a phthalate containing polymer and incorporated in the core a perfume.

10 Claims, No Drawings

FABRIC TREATMENT COMPOSITION COMPRISING A CORE-SHELL PARTICLE BOUND TO A PHTHALATE-CONTAINING POLYMER

TECHNICAL FIELD

The present invention relates to fabric treatment compositions and, more specifically, to compositions comprising particles which comprise a benefit agent (preferentially perfume) and a deposition aid. The invention also relates to the uses of said particles in the formulation of fabric treatment (preferably laundry detergent) compositions, and, delivery of the benefit agent (preferably perfume) to fabric during laundering.

BACKGROUND OF THE INVENTION

The present invention will be described with particular reference to perfume although the technology is believed applicable to other benefit agents used in fabric treatment processes.

In laundry applications deposition of a perfume is used, for example, during fabric treatment processes such as fabric washing and conditioning. Methods of deposition are diverse and include deposition during the wash or rinse stages of the laundry process or direct deposition before or after the wash, such as by spraying or rubbing or by use of impregnated sheets during tumble drying or water additives during steam ironing. The perfume is often incorporated into a carrier or delivery system. Carrier systems for perfumes are typically based on encapsulation or entrapment of the perfume within a matrix. After deposition onto a surface, a problem exists in that longevity of adherence to that surface of the perfume, in a surfactant containing environment, is inherently poor. A perfume which has been deposited onto a fabric may be washed off again during a main wash, or in the perfume may be leached from its carrier into the wash. Protection of the perfume is, therefore, required before and after it has been deposited onto a surface. Much the same problems are encountered with other benefit agents, which are, like perfume typically relatively expensive and present in laundry compositions at relatively low levels.

WO 94/19448 relates to compositions which comprise both a soil release polymer and an encapulated perfume. The soil release polymer is said to improve the deposition of the perfume containing particles.

WO 99/36469 relates to compositions which are substantive to cotton and which contain both perfume containing particles and a polymer which is substantive to cotton, such as locust bean gum.

WO 01/46357 relates to a fusion protein comprising a cellulose binding domain and a domain having a high binding affinity for another ligand. This high affinity binding domain is preferably directed at a Benefit Agent.

WO 07/62833 relates to compositions which comprise core-shell encapsulated perfume particles decorated with locust bean gum.

DEFINITION OF THE INVENTION

We have now determined that the deposition of benefit agents to polyester can be significantly enhanced if the benefit agent is present in particles which are bound to a preferably phthalate-containing deposition aid.

In the context of the present invention the term "polyester" means both fabrics which comprise only polyester and blends of polyester with other materials, such as a "poly-cotton" blends.

Accordingly, a first aspect of the invention provides a particle comprising a benefit agent said particle being bound to a non-cationic deposition aid which is substantive to polyester, wherein the non-cationic deposition aid is a polymer derivable from dicarboxylic acids and polyols. Preferably the particle comprises a core shell encapsulate.

It is particularly preferable that the substantivity to polyester is maintained in the presence of surfactant at concentrations of above 0.1 g/L and preferably also above the surfactants critical micelle concentration in the liquor. This means that the particles show improved deposition on polyester cloth during laundering or other fabric treatment, such as conditioning, due to the presence of the deposition aid.

A second aspect of the present invention provides a method for producing improved benefit agent particles which comprises the step of covalently linking or co-polymerising a deposition aid which is substantive to polyester to a particle comprising the benefit agent. Preferably the method comprises forming an outer polymeric shell on a core comprising a benefit-agent wherein the outer polymeric shell is formed in the presence of a polyester substantive deposition aid.

Preferably the benefit agent comprises a perfume component.

Preferably the polyester-substantive deposition aid is a phthalate containing polymer, more preferably a polymer comprising units derived from (poly)ethylene glycol and terephthalate. Most preferably the polymer is a selected from the group comprising PET/POET, PEG/POET, PET/PEG and phthalate/glycerol/ethylene glycol polymers.

A third aspect of the present invention comprises a method for treating polyester textile articles which comprises laundering the articles in the presence of the aforementioned benefit-agent particles, preferably benefit agent particles which comprise a perfume component.

A fourth aspect of the present invention comprises a laundry treatment composition which comprises the aforementioned benefit-agent particles and at least one detergent and/or at least one fabric conditioner.

The presence of the polyester-substantive deposition aid (which is preferably a polymer of the type described in particular herein) in the shell makes the particles substantive to polyester textile items, this assists in the deposition of the particles during the wash and the retention of the particles on the article being washed. During subsequent use of the articles the benefit agent is released, preferably upon breakage of the particles.

A particular advantage of having an uncharged or anionic polymer is that it does not interact with other formulation components through anionic-cationic binding (such as would be the case with cationic polymers and anionic surfactants). Polymers without cationic groups are also generally envisaged to be less toxic and less prone to malodor production.

As noted above, it is particularly preferable that the benefit agent comprises a perfume component and that the preferred dicarboxylic acid/polyol deposition aid is a phthalate containing polymer, more preferably a (poly)ethylene-terephthalate polymer, more preferably a PET/POET, PEG/POET or PET/PEG polymer. In a particularly preferred embodiment of the invention the particles comprise a shell comprising the aforementioned polyester-substantive polymers and a core comprising one or more perfume components.

Preferably, the shell is formed at least in part by step-growth polymerisation. Typically, these will be melamine/ urea-formaldehyde shells formed by step-growth polymerisation of melamine/urea (or mixtures thereof) and formaldehyde monomers. In the alternative the shell can be formed by an addition polymerisation. If addition polymerisation is used then a methyl methacryl is typically used as monomer and the shells will typically comprise polymethylmethacrylate. Alternative addition polymerisation monomers as discussed in further detail below.

It is preferred that the nonionic or anionic deposition aid is added to the polymerisation mixture only after a shell has at least in part been formed. It is further preferred that polymerisation is concluded in the presence of a different monomer set than was present during the shell formation. Preferred monomers for the conclusion of the emulsion polymerisation are monomers with solubility in water of from 0.1 to 30 g/l. Optionally, monomers with a solubility in water of greater than 30 g/l, and/or cross linkers can also be present. Preferably, the polymerisation is concluded in the presence of at least one addition polymerisation monomer. Typically, these include the ethylenically-unsaturated monomers, particularly vinyl acetate and methyl acrylate.

A further aspect of the invention provides particles obtainable by the process described above.

In a still further aspect, the invention provides an aqueous wash medium comprising from 0.00005 to 0.5 gram per liter of a particle according to the second aspect of the invention.

DETAILED DESCRIPTION OF THE INVENTION

In order that the present invention may be further understood it is described in further detail below with reference to preferred features.

Particles:

While it is preferred to use polymer particles, preferably core-shell encapsulates, many other types of particle can be envisaged as the perfume carrier. Perfumes have been adsorbed onto a clay or zeolite material that is then admixed into particulate detergent compositions: U.S. Pat. No. 4,539,135 discloses particulate laundry compounds comprising a clay or zeolite material carrying perfume. Combinations of perfumes generally with larger pore size zeolites such as zeolite X and Y are also taught in the art. East German Patent Publication No. 248,508, relates to perfume dispensers containing a faujasite-type zeolite (e.g., zeolite X and Y) loaded with perfume. Also, East German Patent Publication No. 137,599, published Sep. 12, 1979 teaches compositions for use in powdered washing agents to provide thermoregulated release of perfume. Zeolites A, X and Y are taught for use in these compositions. Other perfume delivery systems are taught by WO 97/34982 and WO 98/41607, published by The Procter & Gamble. WO 97/34982 discloses particles comprising perfume loaded zeolite and a release barrier, which is an agent derived from a wax and having a size (i.e., a cross-sectional area) larger than the size of the pore openings of the zeolite carrier. WO 98/41607 discloses glassy particles comprising agents useful for laundry or cleaning compositions and a glass derived from one or more of at least partially-water-soluble hydroxylic compounds.

Silicas, amorphous silicates, crystalline nonlayer silicates, layer silicates, calcium carbonates, calcium/sodium carbonate double salts, sodium carbonates, sodalites, alkali metal phosphates, pectin, chitin microbeads, carboxyalkylcelluloses, gums, resins, gelatin, gum arabic, porous starches, modified starches, carboxyalkyl starches, cyclodextrins, maltodextrins, synthetic polymers such as polyvinyl pyrrolidone (PVP), polyvinyl alcohol (PVA), cellulose ethers, polystyrene, polyacrylates, polymethacrylates, polyolefins, aminoplast polymers, crosslinkers and mixtures thereof can all provide a basis for perfume particles.

Polymer particles are preferred.

The polymer particles of the invention can comprise a wide selection of monomeric units. By "monomer units" as used herein is meant the monomeric units of the polymer chain, thus references to "a polymer particle comprising insoluble monomer units" as used herein means that the polymer particles is derived from insoluble monomers, and so forth.

As noted above, the monomer units are preferably derived from monomers which are suitable for either step growth polymerisation or addition/free radical polymerisation.

Monomers for Step Polymerisation:

Suitable classes of such monomers are given in the group consisting of the melamine/urea/formaldehyde class, the isocyanate/diol class (preferably the polyurethanes) and polyesters. Preferred are the melamine/urea formaldehyde class and the polyurethanes.

Monomers for Addition/Free Radical Polymerisation:

Suitable classes of such monomers are given in the group consisting of olefins, ethylene, vinylaromatic monomers, esters of vinyl alcohol with mono- and di-carboxylic acids, esters of α,β-monoethylenically unsaturated mono- and dicarboxylic acids with alcohols, nitriles of α,β-monoethylenically unsaturated carboxylic acids, conjugated dienes, α,β-monoethylenically unsaturated monocarboxylic and dicarboxylic acids and their amides, methacrylic acid and its esters with alcohols and diols, acrylic acid and its esters with alcohols and diols, dimethyl or di-n-butyl maleate, and vinylsulfonic acid and its water-soluble salts, and mixtures thereof. The polymer particle may comprise mixtures of monomer units.

The polymer particle may optionally comprise monomers which are cross-linkers. Such cross-linkers may have at least two non-conjugated ethylenically unsaturated double bonds. Examples are alkylene glycol diacrylates and dimethacrylates. A further type of suitable cross-linking monomers are those that are conjugated, such as divinyl benzene. If present, these monomers constitute from 0.1 to 10% by weight, based on the total amount of monomers to be polymerised.

The monomers are preferably selected from: styrene; α-methylstyrene; o-chlorostyrene; vinyl acetate; vinyl propionate; vinyl n-butyrate; esters of acrylic, methacrylic, maleic, fumaric or itaconic acid with methyl, ethyl, n-butyl, isobutyl, n-hexyl and 2-ethylhexyl alcohol; 1,3-butadiene; 2,3 dimethyl butadiene; and isoprene. The preferred monomers are vinyl acetate and methyl acrylate.

Optionally, the monomers are used as co-polymers with one or more of acrylic acid, methacrylic acid, maleic acid, fumaric acid, itaconic acid, poly(alkylene oxide)monoacrylates and monomethacrylates, N-vinyl-pyrrolidone, methacrylic and acrylic acid, 2-hydroxyethyl acrylates and methacrylates, glycerol acrylates and methacrylates, poly (ethylene glycol)methacrylates and acrylates, n-vinyl pyrrolidone, acryloyl morpholine, vinyl formamide, n-vinyl acetamide and vinyl caprolactone, acrylonitrile (71 g/l), acrylamide, and methacrylamide at levels of less than 10% by weight of the monomer unit content of the particle; 2-(dimethylamino)ethyl methacrylate, 2-(diethylamino)ethyl methacrylate, 2-(tert-butylamino)ethyl methacrylate, 2-aminoethyl methacrylate, 2-(2-oxo-1-imidazolidinyl)ethyl methacrylate, vinyl pyridine, vinyl carbazole, vinyl imidazole, vinyl aniline, and their cationic forms after treatment with alkyl halides;

Optional cross linkers include vinyltoluenes, divinyl benzene, ethylene glycol diacrylate, 1,2-propylene glycol diacrylate, 1,3-propylene glycol diacrylate, 1,3-butylene glycol diacrylate, 1,4-butylene glycol diacrylates, ethylene glycol dimethacrylate, 1,2-propylene glycol dimethacrylate, 1,3-propylene glycol dimethacrylate, 1,3-butylene glycol dimethacrylate, 1,4-butylene glycol dimethacrylate, divinylbenzene, vinyl methacrylate, vinyl acrylate, allyl methacrylate, allyl acrylate, diallyl maleate, diallyl fumarate, methylenebisacrylamide, cyclopentadienyl acrylate, and triallyl cyanurate. It is preferable that the ratio of the monomers used in the shell formation and those used in deposition aid attachment are the ratio of 20:1 to 1:1 (as shell former:deposition linker). Preferably, the ratio is 5:1-2:1, more preferably 4:1-2:1 as better particle deposition on fabric is found as the ratio approaches 2:1.

Deposition Aid:

As noted above the deposition aid is preferably a dicarboxylic aromatic acid/polyol polymer, particularly a phthalate containing polymer, more preferably a (poly)ethyleneterephthalate polymer, more preferably a PET/POET, PEG/POET or PET/PEG polymer. Materials of this type are widely available to the laundry formulator as they are commonly used as soil-release polymers.

Any polymeric soil release agent known to those skilled in the art can be employed in compositions according to the invention. Polymeric soil release agents are characterized by having both hydrophilic segments, to hydrophilize the surface of hydrophobic fibers, such as polyester and nylon, and hydrophobic segments, to deposit upon hydrophobic fibers and remain adhered thereto through completion of washing and rinsing cycles and, thus, serve as an anchor for the hydrophilic segments. This is commonly done to enable stains occurring subsequent to treatment with the soil release agent to be more easily removed in later washing procedures.

The polymeric deposition aids useful herein especially include those soil release agents having one or more nonionic hydrophilic components comprising oxyethylene, polyoxyethylene, oxypropylene or polyoxypropylene segments, and, one or more hydrophobic components comprising terephthalate segments. Typically, oxyalkylene segments of these deposition aids will have a degree of polymerization of from 1 to about 400, although higher levels can be used, preferably from 100 to about 350, more preferably from 200 to about 300.

One type of preferred deposition aid is a copolymer having random blocks of ethylene terephthalate and polyethylene oxide terephthalate. The preferred molecular weight of this class of polymeric deposition aid agent is in the range of from about 5 kD to about 55 kD.

Another preferred polymeric deposition aid is polyester with repeat units of ethylene terephthalate units contains 10-15% by weight of ethylene terephthalate units together with 90-80% by weight of polyoxyethylene terephthalate units, derived from a polyethylene glycol of average molecular weight 0.2 kD-40 kD. Examples of this class of polymer include the commercially available material ZELCON 5126 (from DuPont) and MILEASE T (from ICI). Examples of related polymers can be found in U.S. Pat. No. 4,702,857.

Another preferred polymeric deposition aid is a sulfonated product of a substantially linear ester oligomer comprised of an oligomeric ester backbone of terephthaloyl and oxyalkyleneoxy repeat units and terminal moieties covalently attached to the backbone. These soil release agents are described fully in U.S. Pat. No. 4,968,451. Other suitable polymeric soil release agents include the terephthalate polyesters of U.S. Pat. No. 4,711,730, the anionic end-capped oligomeric esters of U.S. Pat. No. 4,721,580, and the block polyester oligomeric compounds of U.S. Pat. No. 4,702,857.

Preferred polymeric deposition aids also include the soil release agents of U.S. Pat. No. 4,877,896 which discloses anionic, especially sulfoarolyl, end-capped terephthalate esters.

Still another preferred deposition aid is an oligomer with repeat units of terephthaloyl units, sulfoisoterephthaloyl units, oxyethyleneoxy and oxy-1,2-propylene units. The repeat units form the backbone of the oligomer and are preferably terminated with modified isethionate end-caps. A particularly preferred deposition aid of this type comprises about one sulfoisophthaloyl unit, 5 terephthaloyl units, oxyethyleneoxy and oxy-1,2-propyleneoxy units in a ratio of from about 1.7 to about 1.8, and two end-cap units of sodium 2-(2-hydroxyethoxy)-ethanesulfonate. Said soil release agent also comprises from about 0.5% to about 20%, by weight of the oligomer, of a crystalline-reducing stabilizer, preferably selected from the group consisting of xylene sulfonate, cumene sulfonate, toluene sulfonate, and mixtures thereof.

The deposition aid may be straight or branched. Preferably, the polymer is present at levels of between 0.1% to 10% w/w by weight of the total amount of the particle.

In one preferred aspect of the invention the deposition aid is attached to pre-formed particles.

The deposition aid is bound to the particle by means of a covalent bond, entanglement or strong adsorption, preferably by a covalent bond or entanglement and most preferably by means of a covalent bond. By entanglement as used wherein is meant that the deposition aid is adsorbed onto the particle as the polymerisation proceeds and the particle grows in size. It is believed that under such circumstnces part of the adsorbed deposition aid becomes buried within the interior of the particle. Hence at the end of the polymerisation, part of the deposition aid is entrapped and bound in the polymer matrix of the particle, whilst the remainder is free to extend into the aqueous phase.

The deposition aid is preferably mainly attached to the particle surface and is not, to any significant extent, distributed throughout the internal bulk of the particle. Thus the particle which is produced when using a deposition aid according to the preferred process of the invention can be thought of as a "hairy particle". This feature of the invention provides significant cost reduction opportunities for the manufacturer as much less deposition aid is required.

Other types of particle surface morphology may be produced when a deposition aid is attached to the particle of the invention. For example, where a polymer attaches to the particle surface in multiple places, loops may result, or the deposition aid may be in the form of a swollen polymer layer at the particle surface.

Benefit Agents:

The present invention may be applied with any of the benefit agents used in fabric treatment. The benefit agent can be selected from softening agents, finishing agents/protective agents and perfumes.

Examples of softening agents are clays, cationic surfactants or silicone compounds. Examples of finishing agents/protective agents are lubricants, soil repelling agents, soil release agents, photo-protective agents (sunscreens), antistatic agents, dye-fixing agents, whitening agents, including fluorescer, anti-bacterial agents and anti-fungal agents. Other benefit agents include: insect repellents and/or pheromones.

Where used, perfume is typically present in an amount of from 10-85% by total weight of the particle, preferably from 20 to 75% by total weight of the particle.

The perfume suitably has a molecular weight of from 50 to 500.

Useful components of the perfume include materials of both natural and synthetic origin. They include single compounds and mixtures. Specific examples of such components may be found in the current literature, e.g., in Fenaroli's Handbook of Flavor Ingredients, 1975, CRC Press; Synthetic Food Adjuncts, 1947 by M. B. Jacobs, edited by Van Nostrand; or Perfume and Flavor Chemicals by S. Arctander 1969, Montclair, N.J. (USA). These substances are well known to the person skilled in the art of perfuming, flavoring, and/or aromatizing consumer products, i.e., of imparting an odor and/or a flavor or taste to a consumer product traditionally perfumed or flavored, or of modifying the odor and/or taste of said consumer product.

By perfume in this context is not only meant a fully formulated product fragrance, but also selected components of that fragrance, particularly those which are prone to loss, such as the so-called 'top notes'. The perfume component could also be in the form of a profragrance.

WO 2002/038120 (P&G), for example, relates to photolabile pro-fragrance conjugates which upon exposure to electromagnetic radiation are capable of releasing a fragrant species.

Top notes are defined by Poucher (Journal of the Society of Cosmetic Chemists 6(2):80 [1955]). Examples of well known top-notes include citrus oils, linalool, linalyl acetate, lavender, dihydromyrcenol, rose oxide and cis-3-hexanol. Top notes typically comprise 15-25% wt of a perfume composition and in those embodiments of the invention which contain an increased level of top-notes it is envisaged at that least 20% wt would be present within the encapsulate.

Typical perfume components which it is advantageous to encapsulate, include those with a relatively low boiling point, preferably those with a boiling point of less than 300, preferably 100-250 Celsius.

It is also advantageous to encapsulate perfume components which have a low Log P (ie. those which will be partitioned into water), preferably with a Log P of less than 3.0. These materials, of relatively low boiling point and relatively low Log P have been called the "delayed blooming" perfume ingredients and include the following materials:

Allyl Caproate, Amyl Acetate, Amyl Propionate, Anisic Aldehyde, Anisole, Benzaldehyde, Benzyl Acetate, Benzyl Acetone, Benzyl Alcohol, Benzyl Formate, Benzyl Iso Valerate, Benzyl Propionate, Beta Gamma Hexenol, Camphor Gum, Laevo-Carvone, d-Carvone, Cinnamic Alcohol, Cinamyl Formate, Cis-Jasmone, cis-3-Hexenyl Acetate, Cuminic Alcohol, Cyclal C, Dimethyl Benzyl Carbinol, Dimethyl Benzyl Carbinol Acetate, Ethyl Acetate, Ethyl Aceto Acetate, Ethyl Amyl Ketone, Ethyl Benzoate, Ethyl Butyrate, Ethyl Hexyl Ketone, Ethyl Phenyl Acetate, Eucalyptol, Eugenol, Fenchyl Acetate, Flor Acetate (tricyclo Decenyl Acetate), Frutene (tricyclco Decenyl Propionate), Geraniol, Hexenol, Hexenyl Acetate, Hexyl Acetate, Hexyl Formate, Hydratropic Alcohol, Hydroxycitronellal, Indone, Isoamyl Alcohol, Iso Menthone, Isopulegyl Acetate, Isoquinolone, Ligustral, Linalool, Linalool Oxide, Linalyl Formate, Menthone, Menthyl Acetphenone, Methyl Amyl Ketone, Methyl Anthranilate, Methyl Benzoate, Methyl Benyl Acetate, Methyl Eugenol, Methyl Heptenone, Methyl Heptine Carbonate, Methyl Heptyl Ketone, Methyl Hexyl Ketone, Methyl Phenyl Carbinyl Acetate, Methyl Salicylate, Methyl-N-Methyl Anthranilate, Nerol, Octalactone, Octyl Alcohol, p-Cresol, p-Cresol Methyl Ether, p-Methoxy Acetophenone, p-Methyl Acetophenone, Phenoxy Ethanol, Phenyl Acetaldehyde, Phenyl Ethyl Acetate, Phenyl Ethyl Alcohol, Phenyl Ethyl Dimethyl Carbinol, Prenyl Acetate, Propyl Bornate, Pulegone, Rose Oxide, Safrole, 4-Terpinenol, Alpha-Terpinenol, and/or Viridine It is commonplace for a plurality of perfume components to be present in a formulation. In the encapsulates of the present invention it is envisaged that there will be four or more, preferably five or more, more preferably six or more or even seven or more different perfume components from the list given of delayed blooming perfumes given above present in the encapsulated perfume.

Part or all of the perfume may be in the form of a profragrance. For the purposes of the present invention a profragrance is any material which comprises a fragrance precursor that can be converted into a fragrance.

Suitable pro-fragrances are those that generate perfume components which are aldehydes. Aldehydes useful in perfumery include but are not limited to phenylacetaldehyde, p-methyl phenylacetaldehyde, p-isopropyl phenylacetaldehyde, methyinonyl acetaldehyde, phenylpropanal, 3-(4-t-butylphenyl)-2-methyl propanal, 3-(4-t-butylphenyl)-propanal, 3-(4-methoxyphenyl)-2-methylpropanal, 3-(4-isopropylphenyl)-2-methylpropanal, 3-(3,4-methylenedioxyphenyl)-2-methyl propanal, 3-(4-ethylpheny)-2,2-dimethylpropanal, phenylbutanal, 3-methyl-5-phenylpentanal, hexanal, trans-2-hexenal, cis-hex-3-enal, heptanal, cis-4-heptenal, 2-ethyl-2-heptenal, 2,6-dimethyl-5-heptenal, 2,4-heptadienal, octanal, 2-octenal, 3,7-dimethyloctanal, 3,7-dimethyl-2,6-octadien-1-al, 3,7-dimethyl-1,6-octadien-3-al, 3,7-dimethyl-6-octenal, 3,7-dimethyl-7-hydroxyoctan-1-al, nonanal, 6-nonenal, 2,4-nonadienal, 2,6-nonadienal, decanal, 2-methyl decanal, 4-decenal, 9-decenal, 2,4-decadienal, undecanal, 2-methyldecanal, 2-methylundecanal, 2,6,10-trimethyl-9-undecenal, undec-10-enyl aldehyde, undec-8-enanal, dodecanal, tridecanal, tetradecanal, anisaldehyde, bourgenonal, cinnamic aldehyde, a-amylcinnam-aldehyde, a-hexyl cinnamaldehyde, methoxy-cinnamaldehyde, citronellal, hydroxy-citronellal, isocyclocitral, citronellyl oxyacet-aldehyde, cortexaldehyde, cumminic aldehyde, cyclamen aldehyde, florhydral, heliotropin, hydrotropic aldehyde, lilial, vanillin, ethyl vanillin, benzaldehyde, p-methyl benzaldehyde, 3,4-dimethoxybenzaldehyde, 3- and 4-(4-hydroxy-4-methyl-pentyl)-3-cyclohexene-1-carboxaldehyde, 2,4-dimethyl-3-cyclohexene-1-carboxaldehyde, 1-methyl-3-(4-methylpentyl)-3-cyclohexen-carboxaldehyde, p-methylphenoxyacetaldehyde, and mixtures thereof.

Another group of perfumes with which the present invention can be applied are the so-called 'aromatherapy' materials. These include many components also used in perfumery, including components of essential oils such as Clary Sage, Eucalyptus, Geranium, Lavender, Mace Extract, Neroli, Nutmeg, Spearmint, Sweet Violet Leaf and Valerian. By means of the present invention these materials can be transferred to textile articles that will be worn or otherwise come into contact with the human body (such as handkerchiefs and bedlinen).

The perfume may be encapsulated alone or co-encapsulated with carrier materials, further deposition aids and/or fixatives. Preferred materials to be co-encapsulated with the perfume include waxes, paraffins, stabilizers and fixatives.

An optional yet preferred component of capsule is a formaldehyde scavenger. This is particularly advantageous in capsules which may comprise formaldehyde as a consequence of their manufacturing process or components. Formaldehyde scavenger is chosen from: sodium bisulfite, urea, cysteine, cysteamine, lysine, glycine, serine, carnosine, histidine, glutathione, 3,4-diaminobenzoic acid, allantoin, glycouril, anthranilic acid, methyl anthranilate, methyl 4-aminobenzoate, ethyl acetoacetate, acetoacetamide, malonamide, ascorbic acid, 1,3-dihydroxyacetone dimer, biuret, oxamide, benzoguanamine, pyroglutamic acid, pyrogallol, methyl gallate, ethyl gallate, propyl gallate, triethanol amine, succinamide, thiabendazole, benzotriazol, triazole, indoline, sulfanilic acid, oxamide, sorbitol, glucose, cellulose, poly(vinyl alcohol), poly(vinyl amine), hexane diol, ethylenediamine-N, N'-bisacetoacetamide, N-(2-ethylhexyl)acetoacetamide, N-(3-phenylpropyl)acetoacetamide, lilial, helional, melonal, triplal, 5,5-dimethyl-1,3-cyclohexanedione, 2,4-dimethyl-3-cyclohexenecarboxaldehyde, 2,2-dimethyl-1,3-dioxan-4,6-dione, 2-pentanone, dibutyl amine, triethylenetetramine, benzylamine, hydroxycitronellol, cyclohexanone, 2-butanone, pentane dione, dehydroacetic acid, chitosan, or a mixture thereof. Preferred formaldehyde scavengers are sodium bisulfite, ethyl acetoacetate, acetoacetamide, ethylenediamine-N,N'-bisacetoacetamide, ascorbic acid, 2,2-dimethyl-1,3-dioxan-4,6-dione, helional, triplal, lilial and mixtures thereof.

Other benefit agents include photo-bleaches and/or other materials that may become activated when the fabric is being dried, e.g. by line drying or tumble drying.

Process Details:

As noted above the process for the preparation of the particles is preferably a two step process in which the first step forms a capsule around the benefit agent and the second step applies a coating to the capsule which includes the deposition aid. The first step can either be step-growth or addition polymerisation and the second step is preferably addition polymerisation.

It is particularly preferably that the first step uses monomers selected from melamine/urea-formaldehyde or methylmethacrylate or isocyanate/diol, and the second step uses monomers selected from vinyl acetate and/or methyl acyrlate. It is particular preferred that the non-ionic deposition aid is not added until the second step.

For step-growth polymerisation some heating is generally necessary to cause polymerisation to proceed. Initiators and chain transfer agents may also be present in the polymerisation mixture where use is made of any addition polymerisation. Those skilled in the art will recognise that a chemical initiator will generally be required for addition polymerisation but that there are instances in which alternative forms of initiation will be possible, e.g. ultrasonic initiation or initiation by irradiation.

The initiator is preferably a chemical or chemicals capable of forming free radicals. Typically, free radicals can be formed either by homolytic scission (i.e. homolysis) of a single bond or by single electron transfer to or from an ion or molecule (e.g. redox reactions). Suitably, in context of the invention, homolysis may be achieved by the application of heat (typically in the range of from 50 to 100° C.). Some examples of suitable initiators in this class are those possessing peroxide (—O—O—) or azo (—N═N—) groups, such as benzoyl peroxide, t-butyl peroxide, hydrogen peroxide, azobisisobutyronitrile and ammonium persulphate. Homolysis may also be achieved by the action of radiation (usually ultraviolet), in which case it is termed photolysis. Examples are the dissociation of 2,2'-azobis (2-cyanopropane) and the formation of free radicals from benzophenone and benzoin. Redox reactions can also be used to generate free radicals. In this case an oxidising agent is paired with a reducing agent which then undergo a redox reaction. Some examples of appropriate pairs in the context of the invention are ammonium persulphate/sodium metabisulphite, cumyl hydroperoxide/ferrous ion and hydrogen peroxide/ascorbic acid.

Preferred initiators are selected from the following:

Homolytic: benzoyl peroxide, t-butyl peroxide, hydrogen peroxide, azobisisobutyronitrile, ammonium persulphate, 2,2'-azobis (cyanopropane), benzophenone, benzoin, Redox: ammonium persulphate/sodium metabisulphite mixture, cumyl hydroperoxide/ferrous ion mixture and/or hydrogen peroxide/ascorbic acid mixture.

Preferred initiators are ammonium persulphate and hydrogen peroxide/ascorbic acid mixture. The preferred level of initiator is in the range of from 0.1 to 5.0% w/w by weight of monomer, more preferably, the level is in the range of from 1.0 to 3.0% w/w by weight of monomer.

Chain transfer agents can optionally be used. A chain transfer agent contains very labile hydrogen atoms that are easily abstracted by a propagating polymer chain. This terminates the polymerisation of the growing polymer, but generates a new reactive site on the chain transfer agent that can then proceed to initiate further polymerisation of the remaining monomer. Chain transfer agents in the context of the invention typically contain thiol (mercaptan) functionality and can be represented by the general chemical formula RS—H, such as n-dodecyl mercaptan and 2-mercaptoethanol. Preferred chain transfer agents are monothioglycerol and n-dodecyl mercaptan, used at levels of, preferably from 0 to 5% w/w based on the weight of the monomer and more preferably at a level of 0.25% w/w based on the weight of the monomer.

The preferred product of such a process is a slurry or dispersion comprising some 30-50% of solids.

Laundry Treatment Compositions:

The polymer particles of the invention may be incorporated into laundry compositions. This may be done by mixing the slurry/dispersion products as mentioned above with some or all of the other components of the composition, preferably by spraying onto the components. Advantageously, the slurry/dispersion need not be dried extensively (if at all) and this reduces perfume losses.

The polymer particles are typically included in said compositions at levels of from 0.001% to 10%, preferably from 0.005% to 5%, most preferably from 0.01% to 3% by weight of the total composition.

The active ingredient in the compositions is preferably a surface active agent or a fabric conditioning agent. More than one active ingredient may be included. For some applications a mixture of active ingredients may be used.

The compositions of the invention may be in any physical form e.g. a solid such as a powder or granules, a tablet, a solid bar, a paste, gel or liquid, especially, an aqueous based liquid. In particular the compositions may be used in laundry compositions, especially in liquid, powder or tablet laundry composition.

The compositions of the present invention are preferably laundry compositions, especially main wash (fabric washing) compositions or rinse-added softening compositions. The main wash compositions may include a fabric softening agent and the rinse-added fabric softening compositions may include surface-active compounds, particularly non-ionic surface-active compounds.

Thus the present invention provides a laundry treatment composition comprising anionic and/or nonionic surfactant and further comprising core-shell particles, wherein said particles have, incorporated in the shell a polyester-substantive deposition aid which is a phthalate containing polymer and incorporated in the core a perfume.

Another preferred embodiment of the present invention is a laundry treatment composition comprising a cationic fabric conditioner and further comprising core-shell particles, wherein said particles have, incorporated in the shell a polyester-substantive deposition aid which is a phthalate containing polymer and incorporated in the core a perfume.

The detergent compositions of the invention may contain a surface-active compound (surfactant) which may be chosen from soap and non-soap anionic, cationic, non-ionic, amphoteric and zwitterionic surface-active compounds and mixtures thereof. Many suitable surface-active compounds are available and are fully described in the literature, for example, in "Surface-Active Agents and Detergents", Volumes I and II, by Schwartz, Perry and Berch.

The preferred detergent-active compounds that can be used are soaps and synthetic non-soap anionic, and non-ionic compounds.

The compositions of the invention may contain linear alkylbenzene sulphonate, particularly linear alkylbenzene sulphonates having an alkyl chain length of from C8 to C15. It is preferred if the level of linear alkylbenzene sulphonate is from 0 wt % to 30 wt %, more preferably from 1 wt % to 25 wt %, most preferably from 2 wt % to 15 wt %, by weight of the total composition.

The compositions of the invention may contain other anionic surfactants in amounts additional to the percentages quoted above. Suitable anionic surfactants are well-known to those skilled in the art. Examples include primary and secondary alkyl sulphates, particularly C8 to C15 primary alkyl sulphates; alkyl ether sulphates; olefin sulphonates; alkyl xylene sulphonates; dialkyl sulphosuccinates; and fatty acid ester sulphonates. Sodium salts are generally preferred.

The compositions of the invention may also contain non-ionic surfactant. Nonionic surfactants that may be used include the primary and secondary alcohol ethoxylates, especially the C8 to C20 aliphatic alcohols ethoxylated with an average of from 1 to 20 moles of ethylene oxide per mole of alcohol, and more especially the C10 to C15 primary and secondary aliphatic alcohols ethoxylated with an average of from 1 to 10 moles of ethylene oxide per mole of alcohol. Non-ethoxylated nonionic surfactants include alkylpolyglycosides, glycerol monoethers, and polyhydroxyamides (glucamide).

It is preferred if the level of non-ionic surfactant is from 0 wt % to 30 wt %, preferably from 1 wt % to 25 wt %, most preferably from 2 wt % to 15 wt %, by weight of the total composition.

Any conventional fabric conditioning agent may be used in the compositions of the present invention. The conditioning agents may be cationic or non-ionic. If the fabric conditioning compound is to be employed in a main wash detergent composition the compound will typically be non-ionic. For use in the rinse phase, typically they will be cationic. They may for example be used in amounts from 0.5% to 35%, preferably from 1% to 30% more preferably from 3% to 25% by weight of the composition.

Suitable cationic fabric softening compounds are substantially water-insoluble quaternary ammonium materials comprising a single alkyl or alkenyl long chain having an average chain length greater than or equal to C20 or, more preferably, compounds comprising a polar head group and two alkyl or alkenyl chains having an average chain length greater than or equal to C14. Preferably the fabric softening compounds have two long chain alkyl or alkenyl chains each having an average chain length greater than or equal to C16. Most preferably at least 50% of the long chain alkyl or alkenyl groups have a chain length of C18 or above. It is preferred if the long chain alkyl or alkenyl groups of the fabric softening compound are predominantly linear.

Quaternary ammonium compounds having two long-chain aliphatic groups, for example, distearyldimethyl ammonium chloride and di(hardened tallow alkyl) dimethyl ammonium chloride, are widely used in commercially available rinse conditioner compositions. Other examples of these cationic compounds are to be found in "Surfactants Science Series" volume 34 ed. Richmond 1990, volume 37 ed. Rubingh 1991 and volume 53 eds. Cross and Singer 1994, Marcel Dekker Inc. New York".

Any of the conventional types of such compounds may be used in the compositions of the present invention.

The fabric softening compounds are preferably compounds that provide excellent softening, and are characterised by a chain melting $L\beta$ to $L\alpha$ transition temperature greater than 25° C., preferably greater than 35° C., most preferably greater than 45° C. This $L\beta$ to $L\alpha$ transition can be measured by differential scanning calorimetry as defined in "Handbook of Lipid Bilayers", D Marsh, CRC Press, Boca Raton, Fla., 1990 (pages 137 and 337).

Substantially water-insoluble fabric softening compounds are defined as fabric softening compounds having a solubility of less than $1\times10^{-3}$ wt % in demineralised water at 20° C. Preferably the fabric softening compounds have a solubility of less than $1\times10^{-4}$ wt %, more preferably from less than $1\times10^{-8}$ to $1\times10^{-6}$ wt %.

Especially preferred are cationic fabric softening compounds that are water-insoluble quaternary ammonium materials having two C12-22 alkyl or alkenyl groups connected to the molecule via at least one ester link, preferably two ester links. Di(tallowoxyloxyethyl)dimethyl ammonium chloride and/or its hardened tallow analogue is an especially preferred compound of this class.

A second preferred type comprises those derived from triethanolamine (hereinafter referred to as 'TEA quats') as described in for example U.S. Pat. No. 3,915,867. Suitable materials are, for example, N-methyl-N,N,N-triethanolamine ditallowester or di-hardened-tallowester quaternary ammonium chloride or methosulphate. Examples of commercially available TEA quats include Rewoquat WE18 and Rewoquat WE20, both partially unsaturated (ex. WITCO), Tetranyl AOT-1, fully saturated (ex. KAO) and Stepantex VP 85, fully saturated (ex. Stepan).

It is advantageous if the quaternary ammonium material is biologically biodegradable.

It is also possible to include certain mono-alkyl cationic surfactants which can be used in main-wash compositions for fabrics. Cationic surfactants that may be used include quaternary ammonium salts of the general formula R1R2R3R4N+ X— wherein the R groups are long or short hydrocarbon chains, typically alkyl, hydroxyalkyl or ethoxylated alkyl groups, and X is a counter-ion (for example, compounds in which R1 is a C8-C22 alkyl group, preferably a C8-C10 or C12-C14 alkyl group, R2 is a methyl group, and R3 and R4, which may be the same or different, are methyl or hydroxyethyl groups); and cationic esters (for example, choline esters).

The choice of surface-active compound (surfactant), and the amount present, will depend on the intended use of the detergent composition. In fabric washing compositions, different surfactant systems may be chosen, as is well known to the skilled formulator, for handwashing products and for products intended for use in different types of washing machine.

The total amount of surfactant present will also depend on the intended end use and may be as high as 60 wt %, for example, in a composition for washing fabrics by hand. In compositions for machine washing of fabrics, an amount of from 5 to 40 wt % is generally appropriate. Typically the compositions will comprise at least 2 wt % surfactant e.g. 2-60%, preferably 15-40% most preferably 25-35%, by weight of the composition.

Detergent compositions suitable for use in most automatic fabric washing machines generally contain anionic non-soap surfactant, or non-ionic surfactant, or combinations of the two in any suitable ratio, optionally together with soap.

The compositions of the invention, when used as main wash fabric washing compositions, will generally also contain one or more detergency builders. The total amount of detergency builder in the compositions will typically range from 5 to 80 wt %, preferably from 10 to 60 wt %, by weight of the compositions.

Inorganic builders that may be present include sodium carbonate, if desired in combination with a crystallisation seed for calcium carbonate, as disclosed in GB 1 437 950 (Unilever); crystalline and amorphous aluminosilicates, for example, zeolites as disclosed in GB 1 473 201 (Henkel), amorphous aluminosilicates as disclosed in GB 1 473 202 (Henkel) and mixed crystalline/amorphous aluminosilicates as disclosed in GB 1 470 250 (Procter & Gamble); and layered silicates as disclosed in EP 164 514B (Hoechst). Inorganic phosphate builders, for example, sodium orthophosphate, pyrophosphate and tripolyphosphate are also suitable for use with this invention.

The compositions of the invention preferably contain an alkali metal, preferably sodium, aluminosilicate builder. Sodium aluminosilicates may generally be incorporated in amounts of from 10 to 70% by weight (anhydrous basis), preferably from 25 to 50 wt %.

The alkali metal aluminosilicate may be either crystalline or amorphous or mixtures thereof, having the general formula: $0.8\text{-}1.5Na_2O.Al_2O_3.0.8\text{-}6SiO_2$ These materials contain some bound water and are required to have a calcium ion exchange capacity of at least 50 mg CaO/g. The preferred sodium aluminosilicates contain 1.5-3.5 SiO2 units (in the formula above). Both the amorphous and the crystalline materials can be prepared readily by reaction between sodium silicate and sodium aluminate, as amply described in the literature. Suitable crystalline sodium aluminosilicate ion-exchange detergency builders are described, for example, in GB 1 429 143 (Procter & Gamble). The preferred sodium aluminosilicates of this type are the well-known commercially available zeolites A and X, and mixtures thereof.

The zeolite may be the commercially available zeolite 4A now widely used in laundry detergent powders. However, according to a preferred embodiment of the invention, the zeolite builder incorporated in the compositions of the invention is maximum aluminium zeolite P (zeolite MAP) as described and claimed in EP 384 070A (Unilever). Zeolite MAP is defined as an alkali metal aluminosilicate of the zeolite P type having a silicon to aluminium weight ratio not exceeding 1.33, preferably within the range of from 0.90 to 1.33, and more preferably within the range of from 0.90 to 1.20.

Especially preferred is zeolite MAP having a silicon to aluminium weight ratio not exceeding 1.07, more preferably about 1.00. The calcium binding capacity of zeolite MAP is generally at least 150 mg CaO per g of anhydrous material.

Organic builders that may be present include polycarboxylate polymers such as polyacrylates, acrylic/maleic copolymers, and acrylic phosphinates; monomeric polycarboxylates such as citrates, gluconates, oxydisuccinates, glycerol mono-, di and trisuccinates, carboxymethyloxy succinates, carboxymethyloxymalonates, dipicolinates, hydroxyethylimino diacetates, alkyl- and alkenylmalonates and succinates; and sulphonated fatty acid salts. This list is not intended to be exhaustive.

Especially preferred organic builders are citrates, suitably used in amounts of from 5 to 30 wt %, preferably from 10 to 25 wt %; and acrylic polymers, more especially acrylic/maleic copolymers, suitably used in amounts of from 0.5 to 15 wt %, preferably from 1 to 10 wt %.

Builders, both inorganic and organic, are preferably present in alkali metal salt, especially sodium salt, form.

Compositions according to the invention may also suitably contain a bleach system. Fabric washing compositions may desirably contain peroxy bleach compounds, for example, inorganic persalts or organic peroxyacids, capable of yielding hydrogen peroxide in aqueous solution.

Suitable peroxy bleach compounds include organic peroxides such as urea peroxide, and inorganic persalts such as the alkali metal perborates, percarbonates, perphosphates, persilicates and persulphates. Preferred inorganic persalts are sodium perborate monohydrate and tetrahydrate, and sodium percarbonate.

Especially preferred is sodium percarbonate having a protective coating against destabilisation by moisture. Sodium percarbonate having a protective coating comprising sodium metaborate and sodium silicate is disclosed in GB 2 123 044B (Kao).

The peroxy bleach compound is suitably present in an amount of from 0.1 to 35 wt %, preferably from 0.5 to 25 wt %. The peroxy bleach compound may be used in conjunction with a bleach activator (bleach precursor) to improve bleaching action at low wash temperatures. The bleach precursor is suitably present in an amount of from 0.1 to 8 wt %, preferably from 0.5 to 5 wt %.

Preferred bleach precursors are peroxycarboxylic acid precursors, more especially peracetic acid precursors and pernoanoic acid precursors. Especially preferred bleach precursors suitable for use in the present invention are N,N,N',N',-tetracetyl ethylenediamine (TAED) and sodium nonanoyloxybenzene sulphonate (SNOBS). The novel quaternary ammonium and phosphonium bleach precursors disclosed in U.S. Pat. No. 4,751,015 and U.S. Pat. No. 4,818,426 (Lever Brothers Company) and EP 402 971A (Unilever), and the cationic bleach precursors disclosed in EP 284 292A and EP 303 520A (Kao) are also of interest.

The bleach system can be either supplemented with or replaced by a peroxyacid. Examples of such peracids can be found in U.S. Pat. No. 4,686,063 and U.S. Pat. No. 5,397,501 (Unilever). A preferred example is the imido peroxycarboxylic class of peracids described in EPA 325 288, EPA 349 940, DE 382 3172 and EP 325 289. A particularly preferred example is phthalimido peroxy caproic acid (PAP). Such peracids are suitably present at 0.1-12%, preferably 0.5-10%.

A bleach stabiliser (transition metal sequestrant) may also be present. Suitable bleach stabilisers include ethylenediamine tetra-acetate (EDTA), the polyphosphonates such as Dequest (Trade Mark) and non-phosphate stabilisers such as EDDS (ethylene diamine di-succinic acid). These bleach stabilisers are also useful for stain removal especially in products containing low levels of bleaching species or no bleaching species.

An especially preferred bleach system comprises a peroxy bleach compound (preferably sodium percarbonate optionally together with a bleach activator), and a transition metal bleach catalyst as described and claimed in EP 458 397A, EP 458 398A and EP 509 787A (Unilever).

Advantageously in the compositions of the invention benefit agents, particularly, perfume components may be employed which are sensitive to bleaches as the encapsulation of, for example, the perfume component will provide some degree of protection to the perfume component.

The compositions according to the invention may also contain one or more enzyme(s).

Suitable enzymes include the proteases, amylases, cellulases, oxidases, peroxidases and lipases usable for incorporation in detergent compositions. Preferred proteolytic enzymes (proteases) are, catalytically active protein materials which degrade or alter protein types of stains when present as in fabric stains in a hydrolysis reaction. They may be of any suitable origin, such as vegetable, animal, bacterial or yeast origin.

Proteolytic enzymes or proteases of various qualities and origins and having activity in various pH ranges of from 4-12 are available and can be used in the instant invention. Examples of suitable proteolytic enzymes are the subtilisins which are obtained from particular strains of *B. Subtilis B. licheniformis*, such as the commercially available subtilisins Maxatase (Trade Mark), as supplied by Genencor International N.V., Delft, Holland, and Alcalase (Trade Mark), as supplied by Novozymes Industri NS, Copenhagen, Denmark.

Particularly suitable is a protease obtained from a strain of *Bacillus* having maximum activity throughout the pH range of 8-12, being commercially available, e.g. from Novozymes Industri NS under the registered trade-names Esperase (Trade Mark) and Savinase (Trade-Mark). The preparation of these and analogous enzymes is described in GB 1 243 785. Other commercial proteases are Kazusase (Trade Mark obtainable from Showa-Denko of Japan), Optimase (Trade Mark from Miles Kali-Chemie, Hannover, West Germany), and Superase (Trade Mark obtainable from Pfizer of U.S.A.).

Detergency enzymes are commonly employed in granular form in amounts of from about 0.1 to about 3.0 wt %. However, any suitable physical form of enzyme may be used. Advantageously in the compositions of the invention benefit agents, for example, perfume components may be employed which are sensitive to enzymes as the encapsulation of the perfume component will provide some degree of protection to the perfume component.

The compositions of the invention may contain alkali metal, preferably sodium carbonate, in order to increase detergency and ease processing. Sodium carbonate may suitably be present in amounts ranging from 1 to 60 wt %, preferably from 2 to 40 wt %. However, compositions containing little or no sodium carbonate are also within the scope of the invention.

Powder flow may be improved by the incorporation of a small amount of a powder structurant, for example, a fatty acid (or fatty acid soap), a sugar, an acrylate or acrylate/maleate copolymer, or sodium silicate. One preferred powder structurant is fatty acid soap, suitably present in an amount of from 1 to 5 wt %.

Other materials that may be present in detergent compositions of the invention include sodium silicate; antiredeposition agents such as cellulosic polymers; soil release polymers (other than attached to the benefit agent carrying particles); inorganic salts such as sodium sulphate; or lather boosters as appropriate; dyes; coloured speckles; fluorescers and decoupling polymers. This list is not intended to be exhaustive.

The detergent composition when diluted in the wash liquor (during a typical wash cycle) will typically give a pH of the wash liquor from 7 to 10.5 for a main wash detergent.

Particulate detergent compositions are suitably prepared by spray-drying a slurry of compatible heat-insensitive ingredients, and then spraying on or post-dosing those ingredients unsuitable for processing via the slurry. The skilled detergent formulator will have no difficulty in deciding which ingredients should be included in the slurry and which should not. It is particularly useful to add the perfume particles of the present invention via post-dosing.

Particulate detergent compositions of the invention preferably have a bulk density of at least 400 g/liter, more preferably at least 500 g/liter. Especially preferred compositions have bulk densities of at least 650 g/liter, more preferably at least 700 g/liter.

Such powders may be prepared either by post-tower densification of spray-dried powder, or by wholly non-tower methods such as dry mixing and granulation; in both cases a high-speed mixer/granulator may advantageously be used. Processes using high-speed mixer/granulators are disclosed, for example, in EP 340 013A, EP 367 339A, EP 390 251A and EP 420 317A (Unilever).

Liquid detergent compositions can be prepared by admixing the essential and optional ingredients thereof in any desired order to provide compositions containing components in the requisite concentrations. Liquid compositions according to the present invention can also be in compact form which means it will contain a lower level of water compared to a conventional liquid detergent.

In order that the present invention may be further understood and carried forth into practice it will be further described with reference to the following examples:

EXAMPLES

Example 1

Synthesis of Polyester (0609-15B)

Zinc acetate, antimony oxide, dimethyl terephthalate and 2,6-di-tert-butyl-4-methylphenol were supplied by Sinopharm Chemical Reagent Co. Ltd, ethylene glycol, and PEG-10000 were purchased from Aldrich. All the reagents were used as received without further purification.

A three-necked round-bottomed flask was charged with dimethyl terephthalate (97.000 g), ethylene glycol (62.000 g) and zinc acetate (0.0291 g). Under a stream of nitrogen, the mixture was heated gradually to 190~195° C. for about 2.5 hours. After most of the methanol was distilled off, the pressure of the mixture was reduced from 600 mbar to 200 mbar in 15 minutes, and then kept at 200 mbar for further 15 minutes. The product was poured out under nitrogen protection to yield bis-(hydroxyethyl) phthalate as a white solid.

For the next step polycondensation reaction, bis-(hydroxyethyl)phthalate (1.270 g) as prepared above, PEG-10000 (25.000 g), antimony oxide (5 mg, catalyst) and 2,6-di-tert-butyl-4-methylphenol (20 mg, anti-oxidant) were added into a three-necked round-bottomed flask. The mixture was slowly heated to 270~275° C. under 10 mbar for 2.5 hours, and then the product was poured out under nitrogen protection, cooled down to room temperature to yield solid 0609-15B.

Example 2

Surface Attachment of Polyester (0609-15B) to Latex Particles Via an Emulsion Polymerisation Core/Shell Route Synperonic A20 surfactant was obtained from Uniqema Ltd and all other chemicals were obtained from the Sigma-Aldrich Company.

Synperonic A20 (1 g), sodium dodecyl sulphate (0.25 g) and monothioglycerol (0.125 g) were dissolved in de-ionised water (272.2 g), added to a glass reaction flask and heated to 65° C. with stirring. Vinyl acetate (37.5 g) was added to the reaction flask. Ascorbic acid (1 g) was dissolved in de-ionised water (5 g) and aqueous hydrogen peroxide solution (3.3 g, 30% active) was diluted with de-ionised water (5 g) to give two initiator solutions. 75 wt % of both initiator solutions were added to the reaction flask (i.e. 4.5 g of ascorbic acid and 6.2 g of hydrogen peroxide solutions). Shortly after addition an exotherm was generated which raised the reaction temperature to ~80° C. Once the exotherm subsided (~20 minutes) the temperature was maintained at 70° C. After 45 minutes, further vinyl acetate monomer (12.5 g) and an aqueous solution of polyester (1 g, 0609-15B—as produced by the method of Example 1) dissolved in 150 g de-ionised water were added to the reaction flask. On addition the temperature fell to ~55° C. The temperature was increased to 65° C. and the remaining 25 wt % of each initiator solution were added to the flask (i.e. 2.1 g of hydrogen peroxide solution and 1.5 g of ascorbic acid solution). An exotherm of ~7° C. was generated after 10 minutes and the temperature was then maintained at 70° C. for a further 20 minutes. An initiator boost was then added, consisting of aqueous hydrogen peroxide (0.83 g, 30% active) diluted with 5 g of de-ionised water and ascorbic acid (0.25 g) dissolved in de-ionised water (5 g). The polymerisation was allowed to continue for a further 30 minutes. The reaction mixture was then cooled to 30° C. and filtered (through Nylon mesh). The solids content of the final emulsion was ~10% and particle size (via a Malvern Zetasizer) was ~200 nm.

Comparative Example A

PVAc Latex without Surface Attached Polyester (0609-15B)

A comparative (control) sample without any added polyester (0609-15B) was prepared using a procedure identical to the above (example 2). Except 273.2 g of de-ionised water was added to the initial reaction pot and only 150 g of de-ionised water (without polyester 0609-15B) was added at the later stage.

Comparative Example B

PVAc Latex with Pre-Adsorbed Polyester (0609-15B)

An additional control sample was prepared whereby polyester was simply added to comparative example A and allowed to pre-adsorb for 2 days prior to deposition assessment. This sample contains an equivalent level (2 wt % on monomer) of polyester as in Example 2. It was prepared by adding 1.78 g of a 1 wt % polyester (0609-15B) de-ionised water solution to 10 ml of comparative example A latex and allowing to pre-adsorb to the particles for 2 days prior to testing.

Example 3

Comparison of Deposition to Polyester of Latex with and without Surface Attached Polyester (0609-15B) in an Aqueous Environment The delivery of the latex with polyester (example 2) and without polyester (comparative example A) were assessed in pH 10.5 buffered Wirral Water using a Linitester™.

Latex particle deposition was measured by turbidity as follows:

a) Preparation of the Wash Liquor:

100 ml of Wirral water was added to a 500 ml Linitest pot.

b) Simulated Wash (Linitest):

0.08 g (800 ppm on wash liquor) of polymer latex particles with polyester surface attachment (example 2), without (comparative example A) and with pre-adsorbed polyester (comparative example B) were each added to the linitest pots containing wash liquor and agitated slightly to ensure mixing. (Washes were done in duplicate for each sample and results averaged). A 5 ml aliquot was taken from each and the Absorbance at 400 nm recorded using a 5 cm cuvette. This absorbance value represents 100% particles in the wash solution prior to the simulated simulated wash process.

c) Linitest Equipment and Procedure:

A section of unfluoresced knitted polyester measuring 20 cm by 20 cm was placed into each linitest pot containing the wash liquor and polymer particles and the pot was sealed.

The Linitest™ is a laboratory scale washing machine (Ex. Heraeus). The equipment is designed and built to comply with the requirements for international standard test specifications. It is used for small scale detergency and stain removal testing particularly when low liquor to cloth ratios are required.

There are various models of the Linitest commercially available. The model used in this case has a single rotation speed of 40 rpm. The carrier is capable of accommodating twelve 500 ml steel containers and can be operated at temperatures up to 100° C.

The Linitest comprises a 20 liter tank, control system and drive mechanism. Permanent thermostatically controlled tubular heating elements in the base of the tank heat the bath liquor to the required temperature. The stainless steel construction throughout ensures efficient heat transfer to the specimen containers that are mounted on a rotating horizontal carrier driven by a geared motor. The rotating movement of the carrier 'throws' the liquid from one end of the container to the other in a continuous action. This movement simulates the mechanical washing process and additional mechanical action can be obtained by using steel ball bearings or discs.

The Linitest pots were attached to the Linitester cradle and rotated 45 minutes at 40° C. to simulate the main wash.

The cloths were then removed and wrung by hand and a 5 ml aliquot of the remaining wash liquor was taken and the absorbance at 400 nm measured using a 5 cm cuvette as before. From interpolation of the initial calibration curve, the concentration of the particles remaining in the liquor after the wash could be determined and hence the level deposited (wash deposition) on the cloth could be determined by difference.

The Linitest pots were then thoroughly rinsed and the 'wrung' cloths returned to the pots and 100 ml of Wirral water was added. The Linitester bath water was drained and the pots attached to the cradle and rotated for 10 minutes at ambient temperature (~20° C.) to simulate a rinse procedure. The clothes were then removed and wrung by hand. A 5 ml aliquot of the rinse solution was taken and the absorbance at 400 nm determined using a 5 cm cuvette. As before interpolation of the initial calibration plot allowed the particle concentration removed from the cloth during the rinse to be determined and by comparison to the initial level deposited prior to the rinse, the percentage loss from the cloth could be determined. This procedure was repeated a further time to simulate and determine losses from the second rinse.

The Table below illustrates the deposition to polyester results:

| | Main Wash Deposition (%) |
|---|---|
| Comparative Example A (Control - No Polyester) | 0.7 |

-continued

| | Main Wash Deposition (%) |
|---|---|
| Comparative Example B (Pre-Adsorbed Polyester) | 0.8 |
| Example 2 (with Surface Attached Polyester) | 15.4 |

It can be seen that surface attachment of the polyester (0609-15B) via an emulsion polymerisation core/shell route gave very significantly improved particle deposition to polyester, but that the simple pre-adsorption of the polymer gave no significant improvement.

Example 4

Attachment of PET-POET to Pre-Formed Perfume Encapsulates and Wash Deposition Enhancement The following procedure outlines the synthesis of the PET-POET polyester and its attachment to pre-formed perfume encapsulates (5 μm) via the formation of an additional melamine formaldehyde shell in the presence of polyester:

4a) Synthesis of Polyester (PET-POET 170707)

Materials

PET-4900 was a polyethylene terephthalate (Mn=4,900); poly(ethylene glycol) 20,000 (Mn=20,000) was purchased from Fluka; antimony oxide ($Sb_2O_3$), calcium acetate and 2,6-ditert-butyl-4-methylphenol (DBMP) were supplied by Sinopharm Chemical Reagent Co., Ltd. All the reagents were used as received without further purification.

Synthesis of PET-POET Via Transesterification Reaction

The PET-POET sample was prepared utilising a stainless steel reaction kettle which offers mechanical stirring, fine thermo-controlling and high vacuum level. The reaction kettle was supplied by Weihai Auto-control Reaction Kettle Ltd. 80 grams of PEG of 20,000 molecular weight and 5 grams of PET-4900 were used for the transesterification polymerisation. Antimony oxide (20 mg) and calcium acetate (20 mg) were utilised as the catalyst and 2,6-ditert-butyl-4-methylphenol (80 mg) as anti-oxidant. Before heating the reaction mixture, vacuum was applied to the kettle, followed with re-filling with nitrogen. This process was repeated three times; and then under vacuum level below zero mmHg and mechanical stirring at 50 rpm, the temperature was gradually elevated to the reaction temperature around 260° C. and maintained for 5 hours. Transesterification reaction took place with the release of ethylene glycol. The product was taken out of the kettle with a spatula while it was hot, usually at 150° C. The viscous polymer cooled down to hard solid of Mn=30K.

4b) Preparation of Melamine Formaldehyde Shell Pre-Polymer

To a 100 ml conical flask was add 19.5 g formalin (37 wt % aqueous formaldehyde) and 44 g water. The pH of the solution was adjusted to 8.9 using 5 wt % $Na_2CO_3$. 10 g melamine and 0.64 g NaCl were added and stirred for 10 minutes at room temperature. The mixture was heated to 62° C. and stirred until the mixture became clear. This mixture is hereinafter referred to as Prepolymer (1) and consists of 23.2 wt % of trimethyloyl melamine in water.

4c) PET-POET (170707) Grafting to Pre-Formed Perfume Encapsulate

To a 250 ml round bottomed flask fitted with condenser was added 28.2 g of melamine formaldehyde perfume encapsulate slurry (48.6 wt % particle solids) and 69.9 g of water and heated to 75° C. 1.2 g of a freshly prepared pre-polymer (1) solution was added and the pH adjusted to 4.1, using 10 wt % formic acid. 0.7 ml of a 1% PET-POET (using the material obtained in example 4a) solution in water was then added. The mixture was then left to stir, at 75° C. for 2 hours. The solution was then cooled and adjusted to pH 7 using 5 wt % $Na_2CO_3$.

A final dispersion (100 g) consisting of 14 wt % encapsulate solids containing an additional 2 wt % melamine formaldehyde shell and 5 wt % (on final particle weight) of PET-POET was obtained.

4d) Wash Deposition Enhancement

The resulting PET-POET modified sample was then characterized via its ability to deposit from a main wash solution against the unmodified capsule. The Table below illustrates the results.

| Sample | Main wash Deposition % |
|---|---|
| Unmodified Perfume Encapsulates (Comparative) | 5.6 ± 4.6 |
| PET-POET modified Perfume Encapsulates | 25.8 ± 6.9 |

The invention claimed is:

1. A laundry treatment composition comprising an anionic and/or nonionic surfactant, and further comprising core-shell particles, wherein said particles comprise;

a) bound to the shell, a non-cationic, polyester-substantive deposition aid, which is a phthalate containing polymer, wherein the binding is achieved by covalently linking or co-polymerising a phthalate-containing polymer to the shell, and b) in the core, a perfume.

2. A laundry treatment composition comprising a cationic fabric conditioner, and further comprising core-shell particles, wherein said particles comprise;

a) bound to the shell, a non-cationic, polyester-substantive deposition aid, which is a phthalate containing polymer, wherein the binding is achieved by covalently linking or co-polymerising a phthalate-containing polymer to the shell, and b) in the core, a perfume.

3. A composition according to claim 1 wherein the phthalate containing polymer, is a polymer comprising units derived from (poly)ethylene glycol and terephthalate, most preferably selected from the group consisting of PET/POET, PEG/POET, PET/PEG and phthalate/glycerol/ethylene glycol polymers.

4. A composition according to claim 1 wherein the particles further comprise a formaldehyde scavenger.

5. A composition according to claim 1 wherein the shell is formed by step-growth polymerisation.

6. A composition according to claim 1 wherein the shell comprises a polymer selected from the melamine/urea formaldehyde class and the polyurethanes.

7. A composition according to claim 1 wherein the shell is formed by addition polymerisation.

8. A composition according to claim 1 wherein the shell comprises a polymer of which the monomers are selected from the group consisting of styrene; α-methylstyrene; o-chlorostyrene; vinyl acetate; vinyl propionate; vinyl n-butyrate; esters of acrylic, methacrylic, maleic, fumaric or itaconic acid with methyl, ethyl, n-butyl, isobutyl, n-hexyl and 2-ethylhexyl alcohol; 1,3-butadiene; 2,3 dimethyl butadiene; and isoprene.

9. A method for producing a composition as claimed in claim 1, which comprises forming an outer polymeric shell on a core comprising a perfume, wherein the outer polymeric shell is formed in the presence of a phthalate containing polymer which is a polyester-substantive deposition aid.

10. A method for treating polyester textile articles which comprises laundering the articles in the presence of a composition according to claim 1.

* * * * *